United States Patent [19]

Derichs et al.

[11] Patent Number: 4,574,577

[45] Date of Patent: Mar. 11, 1986

[54] DRIVING ARRANGEMENT FOR A SPINNING ROTOR OF AN OPEN-END SPINNING MACHINE

[75] Inventors: Josef Derichs, Monchen-Gladbach; Fritz Stahlecker, Josef-Neidhart-Strasse 18, 7347 Bad Überkingen, both of Fed. Rep. of Germany

[73] Assignees: Hans Stahlecker; Fritz Stahlecker; W. Schlafhorst & Co., all of Fed. Rep. of Germany

[21] Appl. No.: 692,106

[22] Filed: Jan. 17, 1985

[30] Foreign Application Priority Data

Jan. 17, 1984 [DE] Fed. Rep. of Germany ..... 3401315

[51] Int. Cl.[4] ..... D01H 1/135; D01H 1/241; D01H 1/244; D01H 7/22

[52] U.S. Cl. ..... 57/100; 57/88; 57/92; 57/105; 57/406

[58] Field of Search ..... 57/92–94, 57/100, 104, 105, 400, 404, 406, 407, 88, 89

[56] References Cited

U.S. PATENT DOCUMENTS

| | | | |
|---|---|---|---|
| 3,121,306 | 2/1964 | Cizek et al. | 57/105 X |
| 3,802,176 | 4/1974 | Stahlecker | 57/406 X |
| 3,807,157 | 4/1974 | Stahlecker | 57/406 |
| 3,838,560 | 10/1974 | Stahlecker | 57/92 X |
| 3,877,212 | 4/1975 | Canzler | 57/100 |
| 4,070,814 | 1/1978 | Goldammer et al. | 57/89 |
| 4,184,315 | 1/1980 | Braun et al. | 57/89 |
| 4,516,396 | 5/1985 | Stahlecker et al. | 57/407 |

*Primary Examiner*—John Petrakes
*Attorney, Agent, or Firm*—Barnes & Thornburg

[57] ABSTRACT

In the case of an arrangement for disposing and driving a spinning rotor of an open-end spinning unit which, by means of a rotor shaft, is disposed in wedge-shaped gaps formed by two pairs of supporting disks and is driven by a belt looping around it, it is provided that the belt is looped around a driving pulley of an electric motor which, with respect to the supporting disks, is arranged in the area opposite the rotor shaft and which, for the tightening of the belt, is movably held in a guide in a plane extending at least approximately through the wedge-shaped gap. A belt holding device is provided for holding the belt in a relaxed position so that the spinning rotor shaft can be readily axially withdrawn and exchanged without requiring any disassembly of the belt drive.

20 Claims, 6 Drawing Figures

Fig. 2
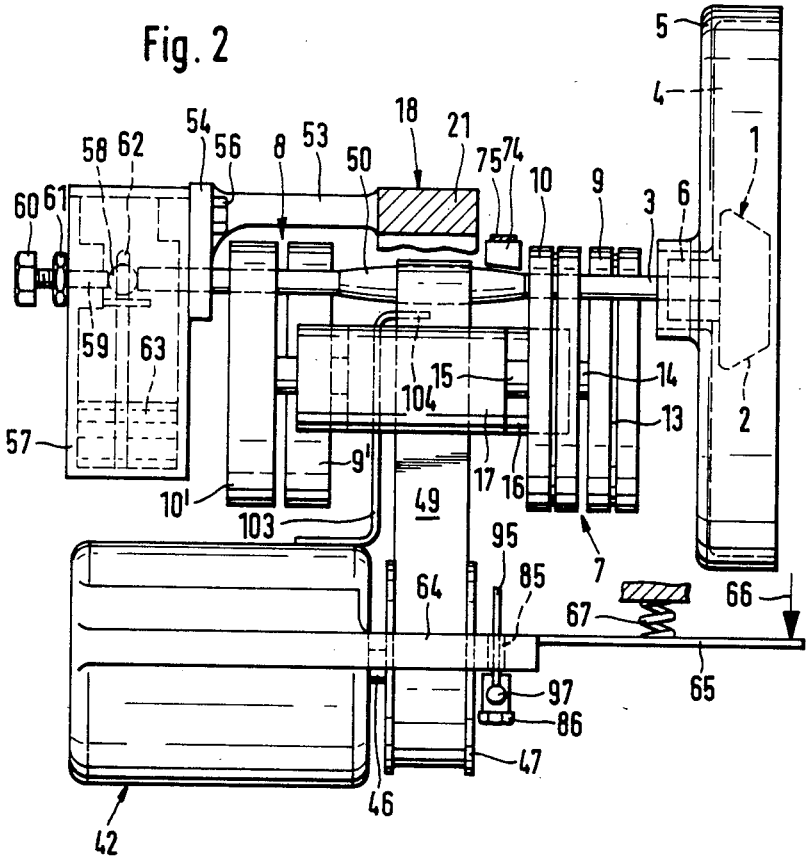
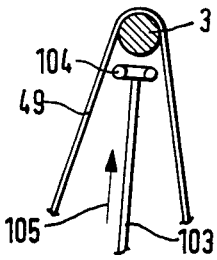
Fig. 2A

Fig. 4
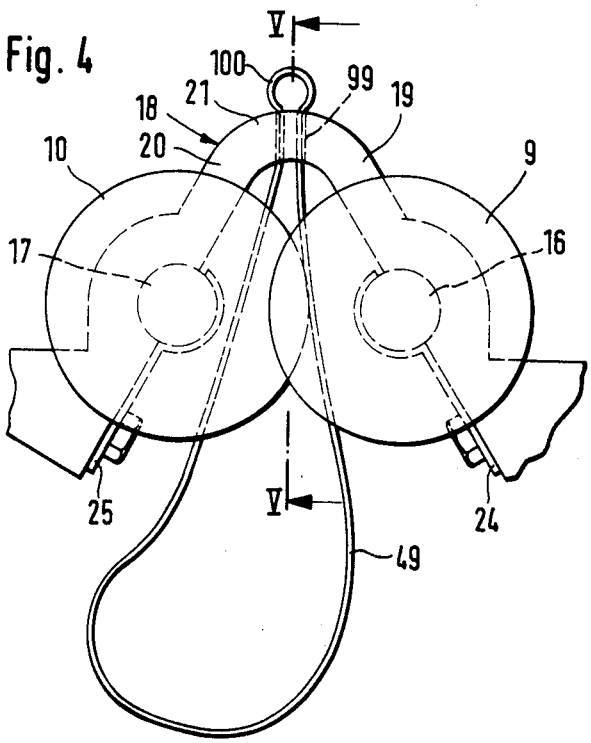
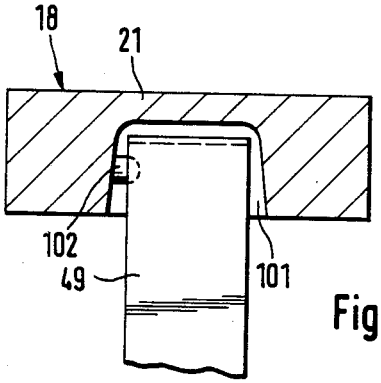
Fig. 5

DRIVING ARRANGEMENT FOR A SPINNING ROTOR OF AN OPEN-END SPINNING MACHINE

BACKGROUND AND SUMMARY OF THE INVENTION

This invention relates to an arrangement for disposing and driving a spinning rotor of an open-end spinning machine, which rotor is disposed with its rotor shaft in a wedge-shaped gap formed by two pairs of supporting disks. The rotor shaft is driven by a continuous belt looping around the rotor shaft between the pairs of supporting disks and pulling the rotor shaft into the wedge-shaped gap.

An arrangement of the above-noted type is disclosed in German Published Unexamined Application (DE-OS) No. 16 85 984 where the belt is driven by a driving pulley arranged on a shaft passing through in the longitudinal direction of the machine and driving, in the same manner, the spinning rotors of the plurality of individual spinning units arranged on one side of the machine. A very costly mechanism is provided for the guiding and tightening of the respective belts. In the case of such a drive, it is difficult to stop an individual spinning rotor and to start it again in a predetermined manner, for example, for repairing a yarn breakage.

In order to utilize the advantages concerning control and operation in the case of separate electric motor drives, it is also known from German Published Unexamined Application (DE-OS) No. 22 03 586 to dispose the shank or shaft of a spinning rotor in the wedge-shaped gap of pairs of supporting disks and to integrate it directly into an electric motor as the rotor. However, this construction was found in practice to be unsatisfactory because it results in considerable difficulties when, for example, the spinning rotor has to be exchanged. In the case of the known construction, this is possible only through costly assembly operations.

The invention is based on the objective of providing a simply constructed and uncomplicated arrangement of the initially mentioned type where the advantages of the easy exchange of the spinning rotor and of an individual drive are realized simultaneously.

This objective is achieved according to the invention by providing that the belt is looped around a driving pulley of an electric motor which, with respect to the pairs of supporting disks, is arranged in the area that is opposite the rotor shaft and which, for the tightening of the belt, is movably held in a guide in a plane that extends at least approximately through the wedge-shaped gap.

In the case of this arrangement of the present invention, a separate drive is assigned to each spinning rotor so that the resulting advantages with respect to the control and operation are maintained. At the same time, the arrangement is constructed in a very simple manner because the electric motor itself, by means of its movable mounting, takes over the tightening of the belt so that additional guiding or tightening devices for the belt are not required. Since the rotor shaft of the spinning rotor does not require complicated molding, the advantages concerning the easy exchange thereof are also maintained.

In an advantageous development of the invention, it is provided that the electric motor is held so that it can be pivoted around a shaft extending in parallel to the rotor shaft of the spinning rotor. This makes possible a very simple construction that ensures a very precise guiding.

In a further advantageous development of the invention, it is provided that the shafts of the pairs of supporting disks extend at least approximately horizontally, that the rotor shaft is placed in the wedge-shaped gap from above, and that the electric motor with the driving pulley is arranged below the pairs of supporting disks. As a result, it is ensured that the rotor shaft is held in the wedge-shaped gap without additional means when the drive is stopped. It is also achieved that the electric motor's own weight is used for the tightening of the belt.

In a further development of the invention, it is provided that the driving pulley of the electric motor is arranged to be laterally displaced with respect to the plane extending vertically through the wedge-shaped gaps and closer to the supporting disks following the driving pulley in the moving direction of the belt. This takes into account the circumstance that in the case of a belt drive, the load is not symmetrical because a larger force is transferred via the pulling end of the belt. By means of the displaced arrangement of the electric motor, the load to the rotor shaft and thus also to the supporting disks can be made more uniform.

In a further development of the invention, it is provided that the pairs of supporting disks are disposed in a joint bearing support having two bearing receiving means assigned to the bearings of the supporting disks; said bearing receiving means being connected with one another via a bridge reaching around the area to be taken up by the rotor shaft of the spinning rotor. This takes into account the fact that the precise positioning of the shafts of the supporting disks has considerable influence on the moving characteristics, especially when, by means of a slight offset of the shafts, the rotor shaft of the spinning rotor is intentionally to be subjected to an axial thrust. By means of the one-piece development of the bearing support, the desired alignments with respect to one another can be achieved with great precision already in the manufacturing plant, without allowing assembly-caused tolerances to have an effect.

In a further development of the invention, it is provided that the guide receiving the electric motor is mounted at the bearing support. As a result, it is achieved that the electric motor forms a constructional unit with the pairs of supporting disks that can be manufactured with high precision.

In a further development of the invention, it is provided that at the bearing support, a step bearing is mounted that receives the free end of the rotor shaft of the spinning rotor. As a result, a necessary step bearing for certain embodiments is also integrated into the constructional unit causing an axial fixing of the rotor shaft and thus of the spinning rotor.

In a further development of the invention, it is provided that the bearing support is fastened at a supporting part via elements made of a vibration-absorbing elastic material. As a result, a noise reduction can be achieved.

In a further development of the invention, it is provided that the rotor shaft of the spinning rotor is provided with a barrel-shaped enlargement in the starting area for the belt. By means of this enlargement, a favorable vibration behavior of the rotor shaft is achieved since the rotor shaft also has the largest cross-section in the area of its highest stress. In addition, the cambered enlargement also results in advantages with respect to the course of the belt.

In a further development of the invention, means are provided for braking the spinning rotor which, directed into the wedge-shaped gap, can be applied to the rotor shaft of the spinning rotor and which are coupled with the electric motor by means of pulling elements in such a way that, starting from an indicated movement of the electric motor directed away from the rotor shaft, the means for braking are applied to the rotor shaft. The means for braking the spinning rotor come in at least when a breakage of the belt should occur, in which case, the means for braking will then immediately take over the securing of the rotor shaft of the spinning rotor in the wedge-shaped gap so that the spinning rotor can carry out no uncontrolled movements.

In a further development of the invention, it is provided that the path of the electric motor away from the rotor shaft is limited by a limit stop. This ensures that in the case of a breakage of the belt, the path of the electric motor is restricted, so that no damage can occur by an uncontrolled movement of the electric motor.

In a further development of the invention, it is provided that means for stopping the electric motor that respond to a breakage of the belt and/or a change of the spun yarn are provided. These measures also have the purpose of further securing the spinning unit. In addition, it may be provided that these means are connected to a control light which can draw the attention of an operating person or of an automatic servicing apparatus to the spinning unit suffering from a disturbance.

In a further development of the invention, means for increasing or reducing the tension of the belt are provided that are applied to the electric motor and/or its holding means. These means may be used to achieve a balancing effect when the weight of the electric motor is too high or too low for a sufficient tension. It is also possible to increase the tension of the belt for a short time via these means, especially when the spinning rotor is accelerated from stoppage to an operational speed. Thus it becomes possible to reduce slippage of the belt.

In a further development of the invention, an actuating element is provided for actuating the means for braking the spinning rotor, said actuating element being coupled with the electric motor or its holding means in such a way that the electric motor is moved in the direction toward the rotor shaft of the spinning rotor during the braking. This ensures that the driving force for the rotor shaft is reduced during braking so that damages to the belt and/or the electric motor are avoided.

In a further development of the invention, means for holding the belt are provided at the bridge of the bearing support. These means are used as an aid during the mounting of the belt since the belt can then tentatively be held in a position in which the rotor shaft of the spinning rotor can be introduced in the wedge-shaped gap in a simple manner.

In a further development of the invention, means for receiving the belt are provided at the electric motor or its holding means which are arranged in proximity of the shank on the side facing the wedge-shaped gap. Thus it is achieved that, when the spinning rotor with its rotor shaft is removed, the belt does not hang about the unit in an uncontrolled manner but is taken up by the receiving means, from where it can be removed in a simple manner, when the shank of the spinning rotor is reintroduced.

In a further development of the invention, it is provided that the supporting disks of the pairs of supporting disks are displaced axially with respect to one another and are arranged so that they overlap one another radially. This results in a compact space-saving construction.

In a further development of the invention, it is provided that the electric motor has a flat-angle accelerating curve and a flat-angle braking curve. This reduces the slippage of the belt so that durability is increased. Generally, an accelerating time or braking time of two to three seconds can be considered as sufficient according to preferred embodiments of the invention.

Further objects, features, and advantages of the present invention will become more apparent from the following description when taken with the accompanying drawings which show, for purposes of illustration only, several embodiments in accordance with the present invention.

BRIEF DESCRIPTION OF THE DRAWINGS

FIG. 2 is a view of the arrangement according to FIG. 1 taken in the direction of the Arrow II, where parts of a bearing support are not shown to facilitate illustration of the other features;

FIG. 2A shows a detail of FIG. 2, viewed in the direction of the rotor shaft of the spinning rotor;

FIG. 4 is a partial view of an arrangement corresponding to FIGS. 1 and 2 for the purpose of depicting the belt introduction process; and FIG. 5 is a partial sectional view taken along Line V—V of FIG. 4 through a modified arrangement of the invention.

DETAILED DESCRIPTION OF THE DRAWINGS

Figure 1:
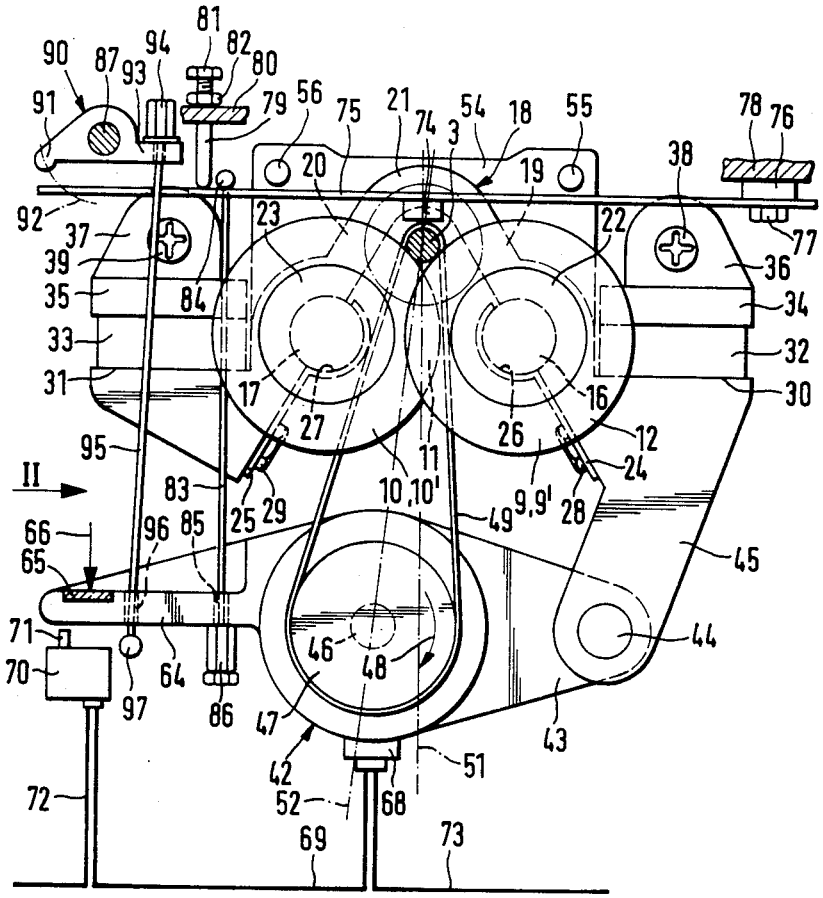
FIG. 1 is a view of an arrangement for disposing and driving a spinning rotor taken from the operating side of a spinning unit at a section of the rotor shaft adjacent to the rotor, showing a preferred embodiment of the present invention.
Figure 3:
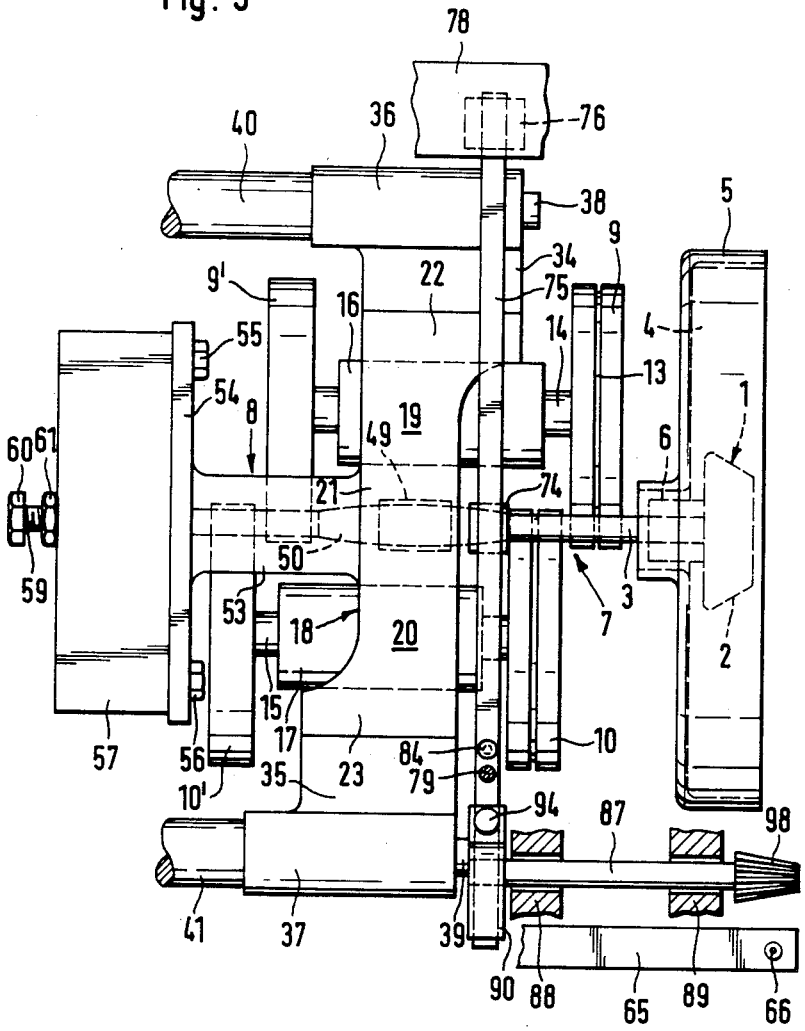
FIG. 3 is a view from above of the arrangement according to FIG. 1.

The spinning rotor assembly 1 used in the illustrated embodiments includes a rotor plate or cup 2 and a rotor shaft 3 of generally known construction. The rotor plate 2, which is arranged in a vacuum chamber 4 of a rotor housing 5 is pressed onto the rotor shaft 3 by means of a collar 6. The rotor housing 5 surrounds the collar 6 by a narrow sealing gap. If necessary, additional sealing elements are provided in this area.

The horizontally disposed rotor shaft 3 of the spinning rotor 1 is disposed from above in the wedge-shaped gap or gaps of two pairs 7 and 8 of supporting disks which take over the radial bearing support of the rotor shaft 3. The supporting disks 9, 10 and 9', 10' of the pairs 7 and 8 of supporting disks are arranged so that they are axially displaced with respect to one another. In addition, they are dimensioned in such a way that they radially overlap over a certain area 11. The supporting disks 9, 10, 9' and 10' are provided with a relatively hard plastic trimming 12, such as a trimming made of a material known under the trade name of Vulkolan. Since the supporting disks 9 and 10 facing the rotor plate 2 are subjected to a higher load, they are somewhat wider than the two rear supporting disks 9' and 10'. In order to avoid an accumulation of heat, the supporting disks 9 and 10 each have a circular groove 13 in the center.

The shafts 14 and 15 of the supporting disks 9, 9' and 10, 10' are each disposed in a bearing housing 16 and 17 by means of roller bearings. The bearing housings 16 and 17 are held in a joint bearing support 18 having two legs 19 and 20 that are disposed at an acute angle (a little less than 90°) with respect to one another, said legs 19 and 20 being connected with one another by a bridge 21 in the area between the supporting disks 9, 9' and 10, 10'. In the legs 19 and 20, bearing receiving means 22 and 23 having bowl-shaped recesses for the bearing housings 16 and 17 are provided, said bearing housings 16 and 17 being clamped in these recesses by means of clamping holders 24 and 25 which have bowl-shaped recesses 26 and 27 and are screwed onto the bearing support by means of screws 28 and 29.

In the area laterally next to the bearing housings 16 and 17, the bearing support 18 is provided with flange-type receiving surfaces 30 and 31 forming a large base with respect to one another. Holders 34 and 35 are fastened at these receiving means 30 and 31 via elastic damping means 32 and 33. Advantageously, the holders 34 and 35 which are provided with flange-type surfaces corresponding to the receiving surfaces 30 and 31 are connected with the damping means 32 and 33 by vulcanizing. The holders 34 and 35, with fastening parts 36 and 37, are fastened at bolts 40 and 41 by means of screws, said bolts 40 and 41 being part of the frame of the spinning unit. At this point, it should be mentioned that, although only one arrangement for disposing and driving is described for an open-end spinning unit, a plurality of such devices arranged next to one another are combined to form a spinning machine.

For the drive of the spinning rotor 1, an electric motor 42 is provided, the housing of which laterally is equipped with a rocking arm 43 which is held so that it can be pivoted on a shaft 44 extending in parallel to the rotor shaft 3. The shaft 44 is received by a projection 45 of the bearing support 18. The shaft 46 of the electric motor 42 carries a driving pulley 47 that is drivable in the direction of the Arrow 48. A belt 49 is looped around this driving pulley 47 and the rotor shaft 3 of the spinning rotor 1 by means of which the rotor shaft 3 of the spinning rotor 1 is driven. Since the electric motor 42 with the driving pulley 47 is arranged below the pairs of supporting disks 7 and 8, the rotor shaft 3 of the spinning rotor 1 is pulled into and secured in the wedge-shaped gaps of the pairs 7 and 8 of supporting disks by means of the belt 49. The pivotal holding of the electric motor 42 has the effect that the belt 49 is tightened by means of the electric motor 42, where, as a rule, the electric motor's own weight is sufficient in order to achieve a satisfactory tightening of the belt.

In the driving area of the belt 49, the rotor shaft 3 of the spinning rotor 1 is provided with a fishbellied or barrel-type enlargement 50 between the pairs 7 and 8 of supporting disks, forming the cambered running surface for the belt 49. Thus it is also achieved that the rotor shaft 3 has a favorable elastic line and a favorable vibration behavior. Since the pulling end of the belt 49 exercises a higher force on the rotor shaft 3 and thus on the supporting disks 9 and 9', the electric motor 42 is arranged so that it is displaced with respect to the plane 51 through the wedge-shaped gaps, i.e. closer to the supporting disks 10 and 10', which follow the driving pulley 47 in the moving direction (Arrow 48) of the belt 49.

On the side facing away from the rotor plate 2, a fastening flange 54 is provided at the bearing support 18 which, via a web 53, is connected with the bridge 21 of the bearing support 18. This fastening flange 54 is used for receiving the housing of a step bearing 57 which is fastened at the fastening flange 54 by means of screws 55 and 56. The step bearing housing 57 contains a step bearing ball 58 arranged in axial extension of the rotor shaft 3 of the spinning rotor 1 against which the end of the rotor shaft 3 supports itself in the axial direction. By means of a slight offsetting of the shafts 14 and 15 of the supporting disks 9, 9' and 10, 10', an axial thrust is exercised on the rotor shaft in a known manner in connection with the rotating direction, by means of which the rotor shaft 3 is pressed against the step bearing ball 58. The step bearing ball 58 itself is supported against a bolt 59 which adjustably is fastened in the rear wall of the step bearing housing 57. The axial position of the bolt 59 can be fixed by means of an adjusting screw 60 and a counter nut 61. A wick 62 rests on the step bearing ball 58 that dips into an oil bath 63 of the step bearing housing 57 and thus continuously supplies the step bearing ball 58 with a lubricant. The freely rotatable step bearing ball 58 is driven to perform rotations by means of vibrations, the vibrations essentially being transferred by the rotor shaft 3.

The housing of the electric motor 42, on the side that is opposite the rocking arm 43, is provided with an arm 64 on which a leaf spring 65 is fastened that is aimed in the direction of the operating side of the spinning unit, i.e. in the direction of the area where the rotor plate 2 is located. By loading the leaf spring 65 with a force 66 aimed downward, which may take place, for example, by means of a servicing unit, the tension of the belt 49 can be increased which, especially during the acceleration of the spinning rotor 1 from stoppage to its operational speed, is utilized for reducing slippage. If the electric motor 42's own weight is not sufficient for a satisfactory tightening of the belt, a loading spring 67 may also be applied to the leaf spring 65 which, with its other end, supports itself at a stationary part of the unit. Should, on the other hand, the weight of the electric motor 42 cause a tension that is too high, a load-reducing spring, instead of the loading spring 67, is arranged at the leaf spring 65 on the opposite side and with an oppositely-directed effect.

The control of the electric motor 42, via a connection 68 and a line 69, is connected to a limit switch 70, the switching element 71 of which is located in the pivotal range of the arm 64 of the housing of the electric motor 42. In the case of a breakage of the belt 49, the arm 64 moves against the switching element 71 of the limit switch, immediately stopping the electric motor 42. Via another line 72, the limit switch 70 is connected to a control light making the disturbance visible to an operating person. Another line 73 leads to the connection 68, said line 73 being connected to a yarn guard that is not shown, by means of which, in the case of an inadmissible change of quality and/or a yarn breakage, the electric motor 42 is also stopped. In order to secure the spinning rotor 1 in the wedge-shaped gaps and in order to avoid uncontrolled movements in the case of a breakage of the belt 49, a brake lining 74 is arranged at a narrow distance from the rotor shaft 3 of the spinning rotor 1. The brake lining 74 is fastened at a leaf spring 75 extending transversely to the shank 3, for example, by gluing, said leaf spring 75 being mounted by means of a screw 77 at a stationary holding means 76 of the machine frame 78. The leaf spring 75 that is prestressed away from the rotor shaft 3 is adjusted by means of an adjusting bolt 79 applied to it in such a way that the brake lining 74 maintains a narrow distance to the rotor shaft 3. The adjusting bolt 79 that is equipped with a screw head 81 and a counter nut 82 is screwed into a thread of a stationary holding means 80. The leaf spring 75, which with respect to the pairs 7 and 8 of supporting disks is clamped in on the side of the pivotal shaft 44, is connected at its free end with a tension member 83, the other end of which is connected to the arm 64 of the housing of the electric motor 42. The tension member 83, that is led through a bore of the leaf spring 75 and is secured by a button 84, is led through a bore 85 of the arm 4 and, on the opposite. side, is provided with an adjustable limit stop 86. When the belt 49 breaks, the arm 64 of the housing of the electric motor 42 takes along the tension member 3 via the limit stop 86 and thus immediately applies the brake lining 74 to the rotor shaft 3 so that this rotor shaft 3 is secured in the wedge-shaped gaps of the pairs 7 and 8 of supporting disks. The paths, in this case, are dimensioned in such a way that the arm 64 also actuates the switching element 1 of the limit switch 70.

Another actuating element 90 is applied to the free end of the leaf spring 75 carrying the brake lining 74, said actuating element 90, being pivotal around a shaft 87 extending in parallel to the shank 3. During the pivoting, by means of an actuating cam 91 moving along an arc 92, the leaf spring 75 is deformed in such a way that the brake lining 74 is applied to the rotor shaft 3. The adjusting shaft 87, which in a self-locking manner is guided in the bearings 88 and 89, is extended to the operating side of the unit, i.e., into the area of the rotor plate 2, and there is provided with a bevel gear 98 to which, for the actuating of the brake, a coupling means of a servicing apparatus can be applied.

On the side opposite the actuating cam 91, the actuating element 90 is equipped with a pulling arm 93 which, via a tension member 95, is coupled to the arm 64 of the housing of the electric motor 42. The tension member 95 is led through a bore of the arm 93 and is provided with a preferably adjustable limit stop 94. The other end of the tension member 95 is put through a bore 96 of the arm 64 and is provided with a stop button 97. The distance between the limit stop 94 and the stop button 97 is adjusted so that during a twisting of the actuating element 90 for the application of the brake lining 74 to the shank 3, the electric motor 42 is lifted at the same time so that the belt 49 is loosened. At the same time, however, the distance of the limit stop 94 and of the stop button 97 is dimensioned in such a way that when the belt 49 breaks, the arm 64 takes a path that is sufficient in order to be able to actuate the switching element 71 of the limit switch 70.

The spinning rotor 1 can be removed from its housing 5 simply by being pulled off. In order to prevent that in the process the belt 49 takes up an uncontrolled position in the unit, a holding strap 103 is mounted at the housing of the electric motor 42 which, with a fork-type end, is arranged in direct proximity of the rotor shaft 3 on the side facing the wedge-shaped gaps (FIG. 2 and 2A). When the spinning rotor 1 is pulled off, the belt 49 falls on the fork 104 so that it remains in the proximity of its operational position. By lifting the electric motor 42 and thus the holding strap 103 and the fork 104 in the direction of the Arrow 105 (FIG. 2A), the belt 49 can be lifted so far that the rotor shaft 3 can reach under it in a simple manner when the spinning rotor 1 is installed again. In this case, it is possible to develop the fork 104 so that transversely to the rotor shaft it can be expanded spring-elastically. It can then be moved past the inserted rotor shaft 3 in downward direction.

It is advantageous to insert the continuous belt 49 as long as the spinning rotor 1 with its rotor shaft 3 is not yet located in the wedge-shaped gaps of the pairs 7 and 8 of supporting disks. In order to facilitate this inserting of the belt 49, it is provided in the case of the embodiment according to FIG. 4 that the bridge 21 has an opening 99 through which the belt 49 is inserted, which outside the bridge 21 will then form a loop 100. Because of its own stiffness, the belt 49 will remain in this position. In this position, the spinning rotor 1 with its rotor shaft 3 can be introduced in a simple manner, after which the belt 49 will then be pulled through the opening 99, be placed on the shank 3 and will then be placed around the driving pulley 47 of the electric motor 42. For this purpose, the electric motor 42 can be lifted.

In the case of the embodiment according fo FIG. 5, a tentative holding of the inserted belt 49 is achieved by the fact that in the bridge 21 of the bearing support 18, a recess 101 is provided that is open in the direction of the pairs of supporting disks and which at one side wall is equipped with a bolt 102 preferably consisting of plastic. The belt 49 can then be hung with a loop over the bolt 102 during the mounting before the spinning rotor 1 is introduced with its rotor shaft 3. By pulling, the belt 49 can then be detached easily from the bolt 102.

In the case of the shown embodiments, a driving pulley 47 is mounted at the electric motor 42 which has a diameter amounting to several times the diameter of the rotor shaft 3 of the spinning rotor 1. However, in order to insert an electric motor 42 that is as small as possible, it is also contemplated to significantly reduce the diameter of the driving pulley 47 and select it to have the size of the diameter of the shank 3 of the spinning rotor 1 according to certain preferred embodiments.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

We claim:

1. An arrangement for disposing and driving a spinning rotor shaft of an open end spinning unit, comprising rotor shaft bearing means for rotatably supporting the rotor shaft including supporting disk means forming a wedge-shaped gap support engaging the rotor shaft, continuous drive belt means looping around the rotor shaft, electric motor drive means including a driving pulley for driving the drive belt means, and electric motor support means for supporting the electric motor in an area opposite the rotor shaft support side of the wedge-shaped gap, said electric motor support means including guide means for movably guiding the electric motor between belt tightening and loosening positions in an area adjacent to a plane through the wedge shaped gap support.

2. An arrangement according to claim 1, wherein the guide means includes a pivot shaft extending in parallel with respect to the rotor shaft of the spinning rotor and means supporting the electric motor for pivotal movement about said pivot shaft.

3. An arrangement according to claim 1, wherein the supporting disk means includes two pairs of supporting disks axially spaced from one another, wherein the drive belt means engages the rotor shaft intermediate the pairs of supporting disks, wherein the shafts of the pairs of supporting disks extend at least approximately horizontally, wherein the rotor shaft is placed in the wedge-shaped gaps from above, and wherein the electric motor drive means with the driving pulley is arranged below the pairs of supporting disks.

4. An arrangement according to claim 3, wherein the driving pulley of the electric motor drive means is arranged to be laterally displaced with respect to a vertical plane extending through the wedge-shaped gaps and closer to the supporting disks following the driving pulley in the moving direction of the drive belt means.

5. An arrangement according to claim 3, wherein the pairs of supporting disks are disposed in a joint bearing support having two bearing receiving means assigned to the bearings of the supporting disks, said bearing receiving means being connected with one another via a bridge reaching around the area to be taken up by the rotor shaft of the spinning rotor.

6. An arrangement according to claim 5, wherein the guide means receiving the electric motor is mounted at the joint bearing support.

7. An arrangement according to claim 5, wherein, at the bearing support, a step bearing is mounted that receives the free end of the shank of the spinning rotor.

8. An arrangement according to claim 5, wherein the bearing support is fastened at a supporting part via fastening elements made of a vibration-damping elastic material.

9. An arrangement according to claim 5, wherein belt holding means for holding the belt means are provided at the bridge of the bearing support.

10. An arrangement according to claim 3, wherein the supporting disks of the pairs of supporting disks are arranged to be axially displaced with respect to one another and radially overlapping one another.

11. An arrangement according to claim 3, wherein the rotor shaft bearing means, rotor shaft, and drive belt means are configured to accommodate , exchange of rotors with a single manual axial movement of the rotor shaft into and out of the wedge-shaped gap without disassembly of any part of the spinning units.

12. An arrangement according to claim 1, wherein the rotor shaft is provided with a barrel-shaped enlargement in the starting area for the belt.

13. An arrangement according to claim 1, wherein braking means for braking the spinning rotor are provided which can be applied to the rotor shaft of the spinning rotor directed into the wedge-shaped gap support, and which are coupled with the electric motor drive means by means of pulling elements in such a way that, started from an indicated movement of the electric motor drive means directed away from the rotor shaft, the braking means for braking are applied to the rotor shaft.

14. An arrangement according to claim 1, wherein the path of the electric motor drive means away from the shank is limited by a limit stop means.

15. An arrangement according to claim 1, wherein motor stopping means for stopping the electric motor drive means are provided that respond to a breakage of the belt and/or a change of the spun yarn.

16. An arrangement according to claim 1, wherein belt tension adjusting means for increasing or reducing the tension of the belt are provided that are applied to one of the electric motor drive means and the motor support means.

17. An arrangement according to claim 1, wherein an actuating element for actuating braking means for the braking of the spinning rotor is provided which is coupled with one of the electric motor drive means and the motor support means in such a way that the electric motor drive means, during the braking, is moved in the direction toward the rotor shaft of the spinning rotor.

18. An arrangement according to claim 1, wherein belt receiving means for receiving the belt are provided at one of the electric motor drive means and the motor support means, which, on the side facing the wedge-shaped support gap, are arranged in proximity of the rotor shaft.

19. An arrangement according to claim 1, wherein the electric motor drive means has a flat-angle accelerating curve and a flat-angle braking curve.

20. An arrangement according to claim 1, wherein the rotor shaft bearing means, rotor shaft, and drive belt means are configured to accommodate exchange of rotors with a single manual axial movement of the rotor shaft into and out of the wedge-shaped gap without disassembly of any part of the spinning units.

* * * * *